US008613265B2

(12) United States Patent
Maruyama et al.

(10) Patent No.: US 8,613,265 B2
(45) Date of Patent: Dec. 24, 2013

(54) DETENT STRUCTURE FOR ROCKER SHAFT

(71) Applicant: Honda Motor Co., Ltd., Tokyo (JP)

(72) Inventors: Sei Maruyama, Wako (JP); Machiko Harada, Wako (JP); Yoshiki Matsushiro, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 13/684,159

(22) Filed: Nov. 22, 2012

(65) Prior Publication Data

US 2013/0133601 A1 May 30, 2013

(30) Foreign Application Priority Data

Nov. 25, 2011 (JP) ..... 2011-257385
Sep. 21, 2012 (JP) ..... 2012-208266

(51) Int. Cl.
*F01L 1/18* (2006.01)

(52) U.S. Cl.
USPC ..... 123/90.13; 123/90.44; 29/888.2; 74/559

(58) Field of Classification Search
USPC ..... 123/90.39, 90.44; 74/559; 29/888.2
See application file for complete search history.

(56) References Cited

U.S. PATENT DOCUMENTS 8,127,727 B2 * 3/2012 Methley et al. ..... 123/90.16

FOREIGN PATENT DOCUMENTS

JP 2646676 B2 1/1990

* cited by examiner

*Primary Examiner* — Ching Chang
(74) *Attorney, Agent, or Firm* — Ditthavong Mori & Steiner, P.C.

(57) ABSTRACT

A detent structure for a rocker shaft includes a camshaft, a rocker shaft, a shaft support, and a detent part. The camshaft is provided at a cylinder head of an engine. The shaft support is provided at the cylinder head to support the rocker shaft and has a support surface supporting the rocker shaft. The detent part is to prevent rotation of the rocker shaft. The detent part includes a bolt insertion hole and a detent bolt. The bolt insertion hole is displaced from a central axis of the rocker shaft and passes through the rocker shaft. The detent bolt is provided in the bolt insertion hole and is fastened to the shaft support to pass across the support surface.

6 Claims, 4 Drawing Sheets

DETENT STRUCTURE FOR ROCKER SHAFT

CROSS-REFERENCE TO RELATED APPLICATIONS

The present application claims priority under 35 U.S.C. §119 to Japanese Patent Application Nos. 2011-257385 and 2012-208266, filed Nov. 25, 2011, and Sep. 21, 2012, entitled "Detent Structure for Rocker Shaft." The contents of these applications are incorporated herein by reference in their entirety.

BACKGROUND OF THE INVENTION

1. Field of the Invention

The present disclosure relates to a detent structure for a rocker shaft.

2. Discussion of the Background

There is an engine that is provided with rocker arms which are rocked by cams of a camshaft which is interlocked with a crankshaft, so that intake valves and exhaust valves are opened and closed by the rocking motions of the rocker arms. The rocker shaft that rotatably supports the rocker arms is a fixed shaft so that its rotation needs to be stopped.

For example, there is an engine a detent structure for preventing rotation of having a rocker shaft disposed under, and in parallel to, a camshaft, and a detent structure for preventing rotation of by providing an oil reservoir recess at the lower half portion of the bearing of the camshaft, and providing a rocker shaft fitting hole in that portion of a cylinder head which lies directly under the oil reservoir recess to support the rocker shaft, and by means of a fixed bolt passing through the rocker shaft from the oil reservoir recess (see, for example, Japanese Patent No. 2646676).

SUMMARY OF THE INVENTION

According to one aspect of the present invention, a detent structure for a rocker shaft includes a camshaft, a rocker shaft, a shaft support, and a detent part. The camshaft is provided at a cylinder head of an engine. The rocker shaft is disposed in parallel to the camshaft to rotatably support rocker arms which are to be driven by cams provided at the camshaft. The shaft support is provided at the cylinder head to support the rocker shaft and has a support surface supporting the rocker shaft. The detent part is to prevent rotation of the rocker shaft. The detent part includes a bolt insertion hole and a detent bolt. The bolt insertion hole is displaced from a central axis of the rocker shaft and passes through the rocker shaft. The detent bolt is provided in the bolt insertion hole and is fastened to the shaft support to pass across the support surface.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings.

DESCRIPTION OF THE EMBODIMENTS

Figure 1:
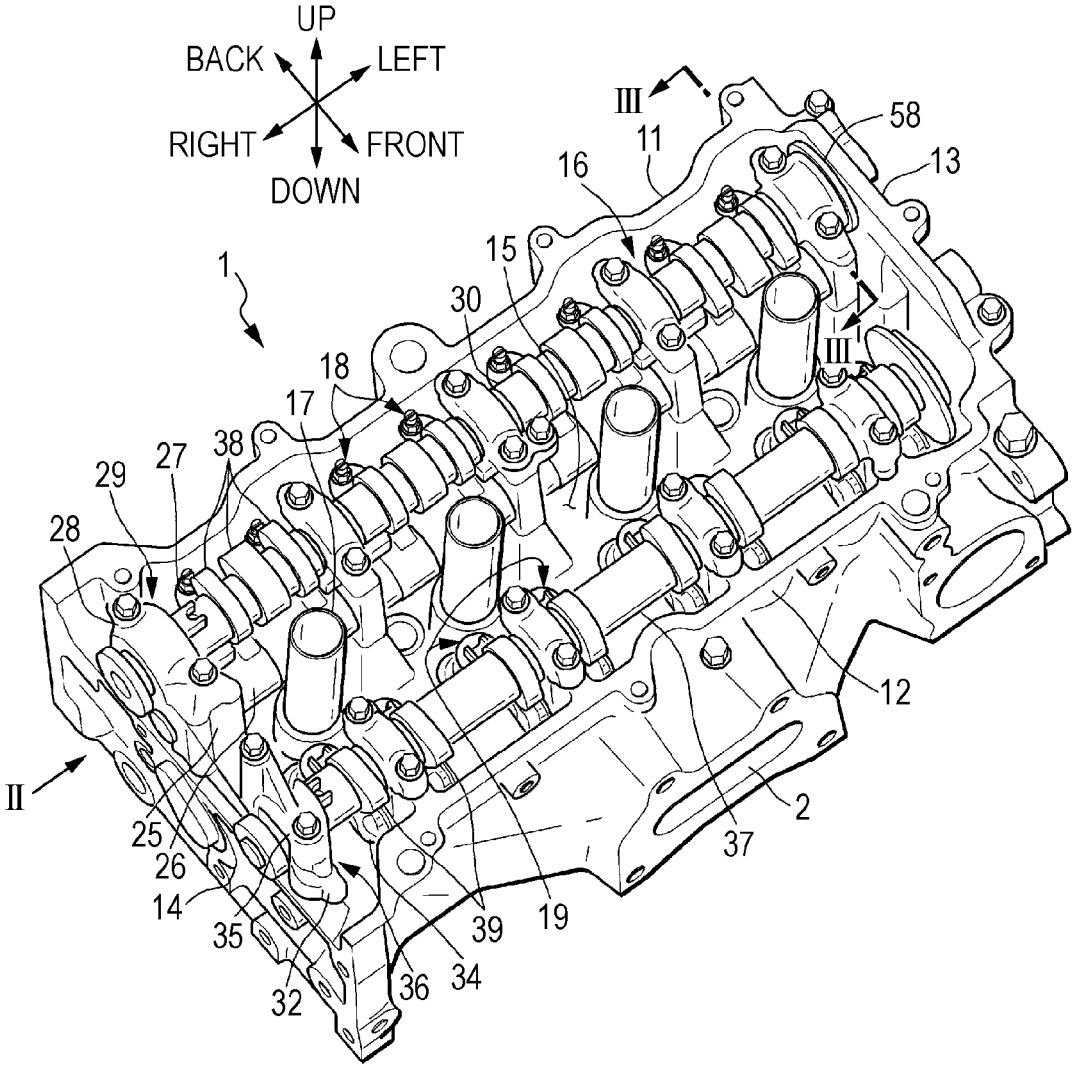
FIG. 1 is a perspective view of the cylinder head of an engine to which an exemplary embodiment of the disclosure is adapted.

The embodiments will now be described with reference to the accompanying drawings, wherein like reference numerals designate corresponding or identical elements throughout the various drawings.

FIG. 1 is a perspective view of a cylinder head 1 of an inline four-cylinder, four-valve DOHC type direct-injection gasoline engine, one example of an engine to which the disclosure is adapted.

As shown in FIG. 1, the cylinder head 1 has a substantially rectangular parallelepiped lower portion elongate horizontally, and a box-shaped upper portion provided at the upper end of the lower portion and having an open top. Formed at the lower portion of the cylinder head 1 are four combustion chambers (not shown) recessed in the lower surface of the cylinder head 1, exhaust ports (not shown) extending frontward from the respective combustion chambers, and intake ports (not shown) extending rearward from the respective combustion chambers to be open to a rear side surface of the cylinder head 1. The front end (downstream end) of an exhaust manifold chamber 2 formed in such a way that the individual exhaust ports are gathered inside the lower portion of the cylinder head 1 is open to a front side surface of the cylinder head 1.

A valve gear chamber 16 having the shape of a substantially rectangular parallelepiped box open upward is defined at the upper portion of the cylinder head 1 by a trailing edge wall 11, a leading edge wall 12, a left edge wall 13 and a right edge wall 14 which are provided upright along the four sides of the lower portion of the cylinder head 1, and a bottom wall 15 serving as the top side of the lower portion. A head cover and a fuel injection pump (neither shown) are fastened onto the upper ends of the trailing edge wall 11, the leading edge wall 12, the left edge wall 13 and the right edge wall 14. The head cover and the fuel injection pump covers the upper portion of the valve gear chamber 16 which receives the drive system. Cylindrical plug insertion cylinders 17 where unillustrated ignition plugs are to be inserted are formed on the bottom wall 15 of the cylinder head 1. Intake valves 18 and exhaust valves 19 which constitute the drive system, and injector holes (not shown) where unillustrated injectors are to be inserted are also provided at the bottom wall 15 of the cylinder head 1.

A plurality of intake-side shaft supports 25 are integrally and protrusively provided on the rear side of the bottom wall 15 in the cylinder bank direction. The intake-side shaft supports 25 are formed like walls standing upright from the bottom wall 15 as a part of the cylinder head 1. An intake-side rocker shaft 26 is securely supported on the intake-side shaft supports 25. Intake-side rocker arms 27 for actuating the respective intake valves 18 in the close direction are rotatably supported on the intake-side rocker shaft 26. A semicylindrical recess is formed in the protruding end (upper end) of the intake-side shaft support 25, and an intake-side bearing cap 28 is fastened to cover the recess. The protruding end of the intake-side shaft support 25 and the intake-side bearing cap 28 form an intake-side camshaft bearing 29. An intake-side camshaft 30 is rotatably supported on the intake-side camshaft bearing 29.

A plurality of exhaust-side shaft supports 32 are integrally and protrusively provided on the front side of the bottom wall 15. An exhaust-side rocker shaft (not shown) is securely supported on the exhaust-side shaft supports 32. Exhaust-side rocker arms 34 to which the respective exhaust valves 19 are coupled are rotatably supported on the exhaust-side rocker shaft. A semicylindrical recess is formed in the protruding end (upper end) of the exhaust-side shaft support 32, and an exhaust-side bearing cap 35 is fastened to cover the recess. The protruding end of the exhaust-side shaft support 32 and the exhaust-side bearing cap 35 form an exhaust-side camshaft bearing 36. An exhaust-side camshaft 37 is rotatably supported on the exhaust-side camshaft bearing 36.

The intake-side camshaft 30, the exhaust-side camshaft 37, the intake-side rocker shaft 26, and the exhaust-side rocker shaft extend in the lengthwise direction (horizontal direction) of the cylinder head 1. Intake-side cams 38 which actuate the intake-side rocker arms 27 are formed on the intake-side camshaft 30, and exhaust-side cams 39 which actuate the exhaust-side rocker arms 34 are formed on the exhaust-side camshaft 37. The intake-side camshaft 30 and the exhaust-side camshaft 37 are rotated by a crankshaft (not shown) via a timing belt (chain) (not shown).

Figure 2:
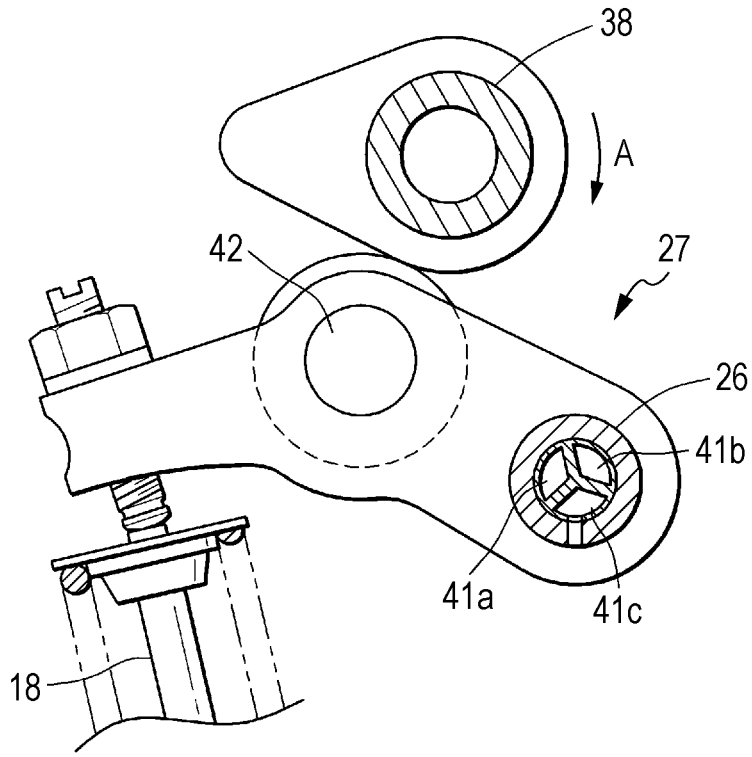
FIG. 2 is an explanatory diagram illustrating the essential portions of an intake-side valve gear mechanism as seen from an arrow II in FIG. 1.

FIG. 2 is a diagram illustrating the essential portions of an intake-side valve gear mechanism as seen from an arrow II in FIG. 1. According to the embodiment, The lift amount and the valve opening timing (phase) of the intake valve 18 is controlled in a plurality of stages (e.g., low speed and high speed) by three intake-side cams 38. The three intake-side cams 38 have a low-speed cam and a high-speed cam with cam profiles different from one another, and are integrally provided on the single intake-side camshaft 30. Three intake-side rocker arms 27 are provided in parallel to one another and to be rotatable independently in association with the three intake-side cams 38, respectively. The intake-side rocker arm 27 which is selected according to the stage is cam-driven to rock by the rotation of the intake-side cam 38 in the direction of an arrow A, and the rocking motion is transmitted to the intake valve 18 to open or close the intake valve 18.

According to the embodiment, there is one kind of cam profile for the exhaust-side cam 39, and the detailed description of the other cam drive specifications, which are the same as those of the intake-side mentioned above, will not be given.

As shown in FIG. 2, three oil passages 41*a*, 41*b* and 41*c* extending in the axial direction and in parallel to one another are provided on the intake-side rocker shaft 26. For example, the oil passage 41*a* communicates with one of the intake-side rocker arms 27, the oil passage 41*b* communicates with another one of the intake-side rocker arms 27, and the remaining oil passage 41*c* is used as a lubrication oil passage. The three intake-side rocker arm 27 are switched from one to another by reciprocating link pins 42, movably provided between the individual intake-side rocker arms 27, by switching the supply of oil pressure from the individual oil passages 41*a*, 41*b*. This structure is publicly known, and its detailed illustration and explanation is omitted. Those cam structures constitute the drive system.

Figure 3:
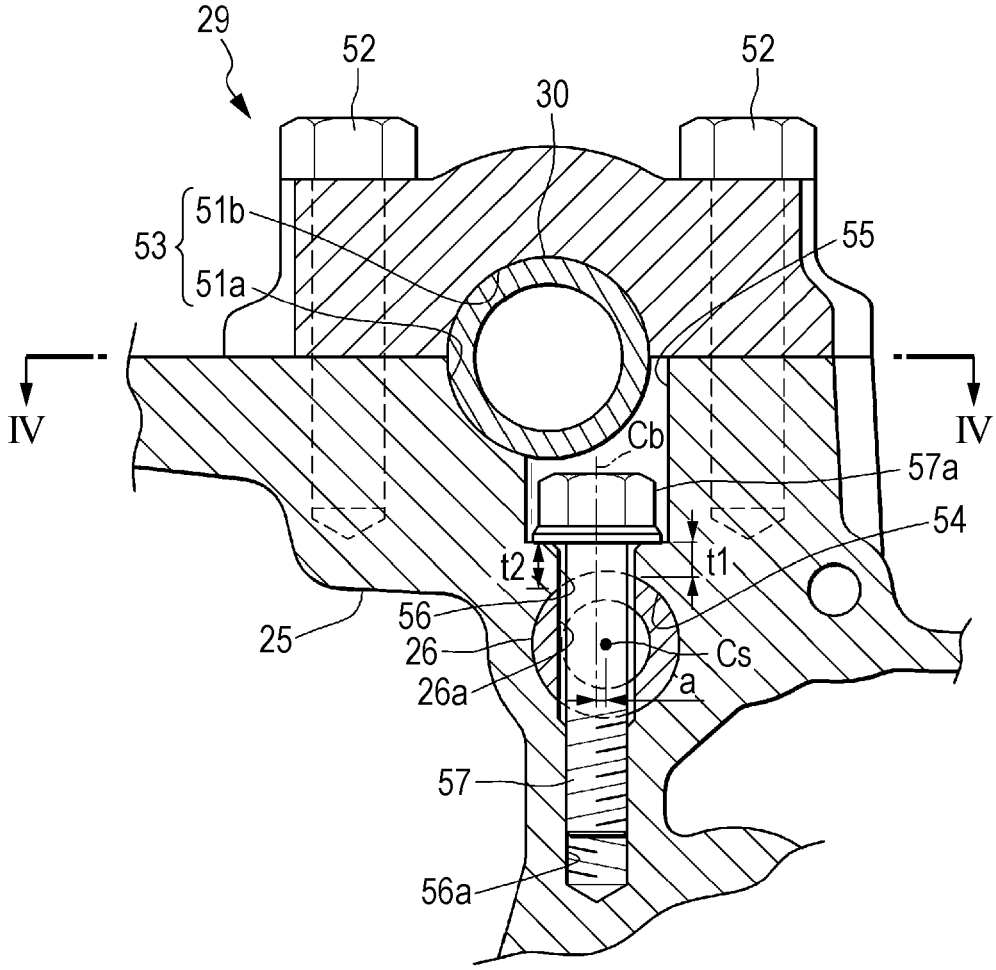
FIG. 3 is a cross-sectional view of the essential portions in enlargement as seen from line III-III in FIG. 1.
Figure 4:
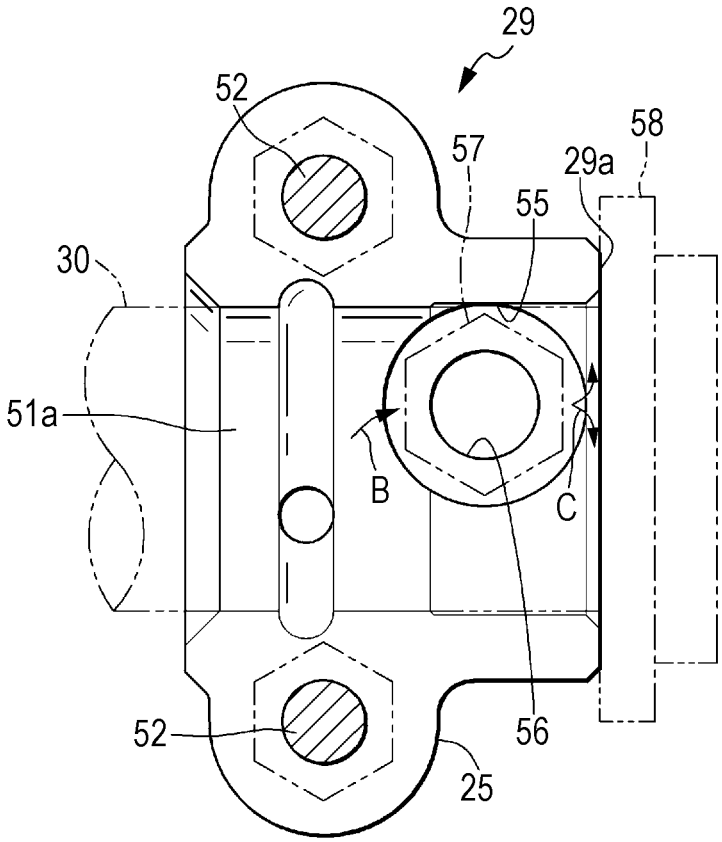
FIG. 4 is a cross-sectional view as seen from line IV-IV in FIG. 3.

FIG. 3 is a cross-sectional view of the essential portions of the intake-side camshaft 30 in enlargement as seen from line III-III in FIG. 1, and FIG. 4 is a cross-sectional view as seen from line IV-IV in FIG. 3.

As shown in FIGS. 3 and 4, a semicylindrical lower bearing surface 51*a*, which constitutes a bearing lower portion supporting a portion of the intake-side camshaft 30 in a lower rotational range is formed at the upper portion of the wall-shaped intake-side shaft support 25. A semicylindrical upper bearing surface 51*b*, which constitutes a bearing upper portion supporting a portion of the intake-side camshaft 30 in an upper rotational range is formed at the intake-side bearing cap 28 to be mounted on the top surface of the intake-side shaft support 25. The intake-side bearing cap 28 is fixed to the intake-side shaft support 25 by a pair of fixed bolts 52, and a cam journal 53 which rotatably support the intake-side camshaft 30 is formed by both bearing surfaces 51*a*, 51*b*.

A support hole 54 formed along the outer shape of the intake-side rocker shaft 26 is provided at a portion of the intake-side shaft support 25 which lies under the intake-side camshaft 30 in FIG. 3, as a support surface supporting the intake-side rocker shaft 26. In the illustrated example, the support hole 54 is provided at an intermediate portion of the intake-side shaft support 25, and thus has a cylindrical surface shape to support the rocker shaft in a penetrated state. However, the shape of the support surface can be changed as needed; for example, in case where the support surface is formed by the support hole 54 with the wall portion provided upright being divided into upper and lower portions, a semicylindrical surface is formed on each of the upper and lower portions, or in case of the support surface that supports the end portion of the rocker shaft, a support surface which supports an end portion of the rocker shaft is formed by a bottomed cylindrical hole (recess) coaxial to the rocker shaft having a bottom surface facing the axial-directional end face of the rocker shaft.

A bottomed cylindrical recess 55 having a size to partially overlies the lower bearing surface 51*a* is provided in the intake-side shaft support 25, and a bolt insertion hole 56 is bored coaxially in the bottom surface of the recess 55. The bolt insertion hole 56 is provided in a direction orthogonal to the axis line of the intake-side rocker shaft 26, and penetrates through the intake-side rocker shaft 26. A bolt insertion hole 26*a* of approximately the same diameter as the bolt insertion hole 56 to match the bolt insertion hole 56 is formed in the intake-side rocker shaft 26. The bolt insertion hole 26*a* of the intake-side rocker shaft 26 is provided at a position displaced from the axis line of the intake-side rocker shaft 26 and in a direction orthogonal to the intake-side rocker shaft 26. The bolt insertion hole 26*a* penetrates through the intake-side rocker shaft 26.

A threaded hole 56*a* in which a detent bolt 57 as a detent member to be inserted in the bolt insertion hole 56 is screwed is provided at that portion of the intake-side shaft support 25 which is opposite to the lower bearing surface 51*a* with the intake-side rocker shaft 26 in between. Therefore, the detent bolt 57 passes across the support surface supporting the intake-side rocker shaft 26 or the support hole 54 in a direction along the diameter thereof to be inserted into the bolt insertion hole 56, so that the insertion directional end of the detent bolt 57 is screwed into the threaded hole 56*a*. A head 57*a* of the detent bolt 57 is received buried in the recess 55 by completely fastening the detent bolt 57 into the threaded hole 56*a*.

The detent bolt 57 is inserted in the bolt insertion hole 56 and is fastened into the threaded hole 56*a* to be securely fixed to the intake-side shaft support 25. The rotation of the intake-side rocker shaft 26 about the axis line is stopped by the detent bolt 57 penetrating the intake-side rocker shaft 26 to be securely fixed.

An axis line Cb of the detent bolt 57 is displaced leftward in FIG. 3 by a predetermined amount a from a center axis line Cs (front and back direction in FIG. 3) in a direction orthogonal to both axis lines Cb, Cs. As a result, the thickness of the portion of the intake-side shaft support 25 which lies between the head 57*a* and the intake-side rocker shaft 26 (between the bottom surface of the recess 55 and the support hole 54) differs between both sides sandwiching the bolt insertion hole 56. A thickness t1 of the portion on the right side to the bolt insertion hole 56 in FIG. 3 (the side of the bolt insertion hole 56 which is opposite to the displaced side) is smaller than a thickness t2 of the portion on the left side (the displaced side of the bolt insertion hole 56).

The thicknesses t1 and t2 of the portions between the head 57*a* and the intake-side rocker shaft 26 in the intake-side shaft support 25 are set so that the portions are plastically deformable by the fastening load of the detent bolt 57. This makes it possible to reduce the weight of the detent structure. Because the portion with the smaller thickness t1 deforms more easily, the amount of deformation of the portion with the smaller thickness t1 toward the intake-side rocker shaft 26 can be increased, and the intake-side rocker shaft 26 can be firmly fixed by the pressing force generated by the deformation.

The inside diameter of the bolt insertion hole 26*a* provided in the intake-side rocker shaft 26 is made larger than the outside diameter of the detent bolt 57 to facilitate insertion of the detent bolt 57. The intake-side rocker shaft 26 can be deformed (rotated) by a clearance which is provided by the difference between the inside and outside diameters, so that the vibration of the engine may be transmitted to be likely to rock and rotate the intake-side rocker shaft 26 forward and reversely. When the intake-side rocker shaft 26 rocks in both directions to hit against the detent bolt 57, noise originating from the hitting sound is generated.

According to the embodiment, however, the detent bolt 57 is displaced from the center axis line Cs of the intake-side rocker shaft 26 as mentioned above, so that the amount of plastic deformation toward the intake-side rocker shaft 26 by the fastening force of the detent bolt 57 differs between both sides (right and left sides in FIG. 3) of the detent bolt 57. This makes a difference in pressing force to the intake-side rocker shaft 26, making it difficult for the intake-side rocker shaft 26 to rotate toward the side where the pressing force is large (thickness t1). Therefore, the intake-side rocker shaft 26 is not rocked in both directions or the forward and reverse directions by the vibration of the engine, so that even when the engine vibrates, generation of a sound of collision of the detent bolt 57 and the intake-side rocker shaft 26 is prevented.

Further, to switch the three intake-side rocker arms 27 in addition to the aforementioned lubrication, the three oil passages 41*a* to 41*c* are provided in the intake-side rocker shaft 26. Because switching of the individual intake-side rocker arms 27 and the relation of communication between the individual intake-side rocker arm 27 and the oil passages 41*a* to 41*c* are determined, the mounting direction with respect to the axial direction of the intake-side rocker shaft 26 is determined. According to the disclosure, the bolt insertion hole 26*a* is displaced from the center axis line Cs, so that the detent bolt 57 cannot be inserted when the mounting direction is wrong. This prevents wrong mounting of the intake-side rocker shaft 26.

Because the portion of the intake-side shaft support 25 which lies between the head 57*a* and the intake-side rocker shaft 26 is plastically deformed to stop the rotation of the intake-side rocker shaft 26, it is unnecessary to directly couple the detent bolt 57 to the intake-side rocker shaft 26. Therefore, the diameter of the bolt insertion hole 26*a* provided in the intake-side rocker shaft 26 can be made large to some extent, facilitating alignment of the bolt insertion hole 56 with the bolt insertion hole 26*a* and ensuring higher mounting efficiency.

Further, the recess 55 is provided in the lower bearing surface 51*a* in such a way as to partially overlie the lower bearing surface 51*a* as mentioned above. Accordingly, the lubrication oil supplied to the lower bearing surface 51*a* flows into the recess 55 as shown by an arrow B in FIG. 4, the recess 55 serves as an oil reservoir, and the lubrication oil in the recess 55 can flow outside from the intake-side camshaft bearing 29 as shown by an arrow C.

Furthermore, the recess 55 is provided in the lower bearing surface 51*a* and displaced on the downstream side or the forward side in the rotational direction (arrow A in FIG. 3) of the intake-side camshaft 30. Because the load on that side of the lower bearing surface 51*a* where the intake-side camshaft 30 rotates (downstream side in the rotational direction of the intake-side camshaft 30), and the recess 55 is provided close to that portion, the contact area of the light-load portion of the lower bearing surface 51*a* to the intake-side camshaft 30 is reduced. This reduces the rotational frictional resistance of the intake-side camshaft 30, thus making it possible to improve the mechanical efficiency of the intake-side camshaft 30.

A disk-shaped thrust plate 58 which can slide in contact with an axial-directional end face 29*a* of the intake-side camshaft bearing 29 is provided on the intake-side camshaft 30. The abutment of the thrust plate 58 on the axial-directional end face 29*a* restricts the movement of the intake-side camshaft 30 in the axial direction. The flow of the lubrication oil which is permitted by the provision of the recess 55 in the above manner ensures lubricating performance between the thrust plate 58 and the axial-directional end face 29*a*.

Although the intake-side rocker shaft 26 has been discussed in the foregoing description of the embodiment, the same may be applied to the exhaust-side rocker shaft, so that the detailed description thereof is omitted.

Although the use of the detent bolt 57 as the detent member has been discussed, the detent member is not limited to a bolt. For example, the threaded hole 56*a* may be formed as a cylindrical hole in which a rod-like member or a pin may be press fitted.

Although one exemplary embodiment of the disclosure has been described herein, it should be apparent to those skilled in the art that the disclosure is not limited to the embodiment, and may be modified as needed without departing from the spirit or scope of the disclosure. Further, not all the illustrated components of the embodiment are essential, and the components may be properly selected.

A detent structure for a rocker shaft according to one aspect of an exemplary embodiment includes a camshaft (30) provided at a cylinder head (1) of an engine, a rocker shaft (26) disposed in parallel to the camshaft to rotatably support rocker arms (27) which are driven by cams provided at the camshaft, a shaft support (25) provided at the cylinder head to support the rocker shaft, and having a support surface (54) supporting the rocker shaft, and a detent part that prevents rotation of the rocker shaft, the detent part having a bolt insertion hole (56) provided so as to pass a position displaced from a central axis of the rocker shaft and pass through the rocker shaft, and a detent bolt (57) to be inserted in the bolt insertion hole and fastened to the shaft support so as to pass across the support surface.

According to this configuration of the exemplary embodiment, the bolt insertion hole is provided at the position displaced from the central axis of the rocker shaft, so that the direction of mounting the rocker shaft can be defined. As mentioned above, in the engine that changes the degrees of opening of the intake and exhaust valves and the timing of opening the intake and exhaust valves by selecting plural kinds of cams and rocker arms, and has a plurality of oil passages inside the rocker shaft so that coupling or non-coupling of a plurality of rocker arms is selected by changing the oil pressures in the individual oil passages, the wrong direction of mounting the rocker shaft breaks the relation between the individual oil passages and the individual rocker arms. However, the displaced structure of the present configuration can prevent the wrong mounting of the rocker shaft.

In the detent structure according to the exemplary embodiment, it is preferable that the support surface should be defined by a hole (54) formed in the shaft support along an outer shape of the rocker shaft, and a portion of the shaft support which lies between a head (57*a*) of the detent bolt and the rocker shaft should be formed thin enough to be plastically deformable by fastening force of the detent bolt, and the rocker shaft should be fixed by the plastic deformation.

According to this configuration of the exemplary embodiment, the fastening force of the detent bolt plastically deforms the portion of the shaft support which lies between the head of the detent bolt and the rocker shaft, and the abutment of the deformed end on the peripheral surface of the rocker shaft fixes the rocker shaft more firmly. This can prevent rattling of the rocker shaft from being caused due to the clearance between the detent bolt and the bolt insertion hole when the engine vibrates, and can suppress the vibration of the rocker shaft.

In the above detent structure according to the exemplary embodiment, it is preferable that the camshaft should be rotatably supported by a cam bearing (53) including a bearing lower portion provided at the shaft support, and a bearing upper portion formed at a bearing cap (28) to be coupled to the shaft support, the bolt insertion hole should be provided to extend toward inside the shaft support from the bearing lower portion, and a recess (55) for receiving the head of the detent bolt should be provided in a bearing surface (51*a*) of the bearing lower portion so as to at least partially overlap the bearing surface.

According to this configuration of the exemplary embodiment, the detent bolt can be inserted from above in case of mounting the camshaft, so that it is easy to see the fastened portion of the detent bolt provided at the shaft support, improving the working efficiency, and additionally the bolt insertion hole for the detent bolt can be seen at the time of mounting the camshaft, surely preventing fastening of the detent bolt from being forgotten. Particularly, because the recess for receiving the head of the detent bolt is larger in diameter than the bolt insertion hole, it is much easier to visually check if mounting the detent bolt is forgotten. Further, the recess for receiving the head of the detent bolt is provided in the bearing surface of the bearing lower portion so as to at least partially overlap the bearing surface, so that it is possible to keep smoother rotation of the camshaft by using the lubrication oil remaining in the recess while maintaining the bearing area of the cam bearing.

In the above detent structure according to the exemplary embodiment, preferably, the recess is displaced forward from a rotational direction of the camshaft at the bearing surface of the bearing lower portion.

According to this configuration of the exemplary embodiment, the recess is provided on the rotational side (downstream side of the rotational direction) of the bearing surface of the bearing lower portion of the cam bearing, reducing the contact area of the recess-formed side with the camshaft. In case of rotatably supporting the rocker shaft on the bearing surface of the bearing lower portion, the load becomes lighter on the downstream side of the camshaft in the rotational direction, so that reducing the contact area of the recess-formed side with the camshaft raises no problem, but brings about the effect of reducing the rotational frictional resistance of the camshaft.

In the detent structure according to the exemplary embodiment, it is preferable that the camshaft integrally should have a thrust plate (58) slidable in contact with the cam bearing so as to restrict an axial-directional movement of the camshaft, and the recess should be displaced toward the thrust plate at the bearing surface of the bearing lower portion.

According to this configuration of the exemplary embodiment, the lubrication oil remaining in the recess is supplied as lubrication oil to the slide portion between the thrust plate provided so as to restrict the axial-directional movement of the camshaft, and the bearing lower portion, making it possible to prevent the thrust plate and the bearing portion from wearing.

According to the exemplary embodiment, the bolt insertion hole is provided at the position displaced from the central axis of the rocker shaft, so that the direction of mounting the rocker shaft can be defined to prevent the wrong mounting of the rocker shaft. Further, the portion of the shaft support which lies between the head of the detent bolt and the rocker shaft is formed thin, and the thin portion is plastically deformed by the fastening force of the detent bolt to fix the rocker shaft more firmly. This can prevent rattling of the rocker shaft from being caused by vibration of the engine, and can suppress the vibration of the rocker shaft. Furthermore, the recess for receiving the head of the detent bolt is provided in the bearing surface of the bearing lower portion so as to at least partially overlap the bearing surface, so that the bolt insertion hole for the detent bolt can be seen at the time of mounting the camshaft, thus surely preventing fastening of the detent bolt from being forgotten. Moreover, oil can be stored in the recess, and can be desirably supplied as lubrication oil.

Obviously, numerous modifications and variations of the present invention are possible in light of the above teachings. It is therefore to be understood that within the scope of the appended claims, the invention may be practiced otherwise than as specifically described herein.

What is claimed is:

1. A detent structure for a rocker shaft, comprising:

a camshaft provided at a cylinder head of an engine;

a rocker shaft disposed in parallel to the camshaft to rotatably support rocker arms which are to be driven by cams provided at the camshaft;

a shaft support provided at the cylinder head to support the rocker shaft and having a support surface supporting the rocker shaft; and a detent part to prevent rotation of the rocker shaft, the detent part comprising:

a bolt insertion hole displaced from a central axis of the rocker shaft and passing through the rocker shaft; and a detent bolt provided in the bolt insertion hole and fastened to the shaft support to pass across the support surface.

2. The detent structure according to claim 1, wherein the shaft support includes a hole defining the support surface and provided along an outer shape of the rocker shaft, wherein a portion of the shaft support provided between a head of the detent bolt and the rocker shaft is thin to be plastically deformable by fastening force of the detent bolt, and wherein the rocker shaft is fixed to the shaft support by the plastic deformation.

3. The detent structure according to claim 1, wherein the camshaft is rotatably supported by a cam bearing including a bearing lower portion provided at the shaft support, and a bearing upper portion provided at a bearing cap coupled to the shaft support, wherein the bolt insertion hole extends toward inside the shaft support from the bearing lower portion, and wherein a recess to receive a head of the detent bolt is provided in a bearing surface of the bearing lower portion to at least partially overlap the bearing surface.

4. The detent structure according to claim 3, wherein the recess is displaced forward from a rotational direction of the camshaft at the bearing surface of the bearing lower portion.

5. The detent structure according to claim 3, wherein the camshaft integrally includes a thrust plate slidably in contact with the cam bearing to restrict an axial-directional movement of the camshaft, and wherein the recess is displaced toward the thrust plate at the bearing surface of the bearing lower portion.

6. The detent structure according to claim 1, wherein a central axis of the detent bolt is displaced from the central axis of the rocker shaft.

* * * * *